US007726782B2

(12) United States Patent
Tsuchikawa

(10) Patent No.: US 7,726,782 B2
(45) Date of Patent: Jun. 1, 2010

(54) IMAGE GENERATING APPARATUS

(75) Inventor: Tatsuyoshi Tsuchikawa, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 482 days.

(21) Appl. No.: 11/783,868

(22) Filed: Apr. 12, 2007

(65) Prior Publication Data

US 2007/0273723 A1 Nov. 29, 2007

(30) Foreign Application Priority Data

May 23, 2006 (JP) ..... 2006-142603

(51) Int. Cl.
*B41J 2/05* (2006.01)

(52) U.S. Cl. ..... 347/60; 347/19; 347/61; 347/185; 347/186

(58) Field of Classification Search ..... 347/60
See application file for complete search history.

(56) References Cited

U.S. PATENT DOCUMENTS 5,204,704 A 4/1993 Genno et al.
5,220,350 A 6/1993 Fujii
5,453,765 A * 9/1995 Yamaguchi et al. ..... 347/179
5,980,134 A * 11/1999 Yanagisawa et al. ... 400/120.14
6,406,113 B1 * 6/2002 Kato ..... 347/14
2004/0233269 A1 * 11/2004 Tsubota ..... 347/223

FOREIGN PATENT DOCUMENTS

JP 62-242554 A 10/1987
JP 5-155059 A 6/1993
JP 6-238939 A 8/1994
JP 6-297748 A 10/1994
JP 10-217529 A 8/1998

OTHER PUBLICATIONS

Extended European Search Report dated Sep. 18, 2007 (Four (4) pages).

* cited by examiner

*Primary Examiner*—Matthew Luu
*Assistant Examiner*—Brian J Goldberg
(74) *Attorney, Agent, or Firm*—Crowell & Moring LLP

(57) ABSTRACT

This image generating apparatus comprises a control portion printing a print image by predicting an ambient temperature in an apparatus body substantially reaching a constant level after continuously printing the same print image from the data quantity of the print image and adding a heat quantity corresponding to the difference between the predicted ambient temperature in the apparatus body and a printing-time ambient temperature in the apparatus body detected by a second temperature sensor to a heat quantity of a thermal head decided in response to a printing-time temperature of the thermal head detected by a first temperature sensor.

14 Claims, 13 Drawing Sheets

| DATA QUANTITY | E=1 | E=2 | E=3 | E=4 | ··· | E=67 | E=68 | E=69 | E=70 |
|---|---|---|---|---|---|---|---|---|---|
| Y PREDICTED TEMPERATURE TABLE | 44.07 | 44.11 | 44.15 | 44.19 | ··· | 46.85 | 46.89 | 46.94 | 47.00 |
| M PREDICTED TEMPERATURE TABLE | 43.59 | 43.63 | 43.67 | 43.71 | ··· | 46.19 | 46.23 | 46.27 | 46.31 |
| C PREDICTED TEMPERATURE TABLE | 43.96 | 43.99 | 44.01 | 44.04 | ··· | 45.70 | 45.72 | 45.75 | 45.78 |

IMAGE GENERATING APPARATUS

BACKGROUND OF THE INVENTION

1. Field of the Invention

The present invention relates to an image generating apparatus, and more particularly, it relates to an image generating apparatus comprising a thermal head.

2. Description of the Background Art

An image generating apparatus comprising a thermal head is known in general. This conventional image generating apparatus prints images on a paper or the like by applying energy to a heating element so that the heating element generates heat. In general, the aforementioned image generating apparatus controls a thermal head by detecting the temperature thereof or the ambient temperature around the thermal head. For example, Japanese Patent Laying-Open Nos. 5-155059 (1993), 6-297748 (1994), 6-238939 (1994) and 10-217529 (1998) disclose such image generating apparatuses.

Thermal head control means described in the aforementioned Japanese Patent Laying-Open No. 5-155059 is so formed as to detect the ambient temperature of the image generating apparatus with a thermistor (temperature sensor) for controlling an electrification type for a thermal head.

Thermal head control means described in the aforementioned Japanese Patent Laying-Open No. 6-297748 receives temperature information from a head temperature detecting portion and a printing ambient temperature (ambient temperature) detecting portion and controls a pulse width of a thermal head with a fuzzy inference portion on the basis of a fuzzy inference, in order to keep a printing concentration constant. The fuzzy inference portion is so formed as to control the pulse width to three levels by reducing the pulse width if the temperature of the thermal head is higher than a prescribed thermal head temperature, setting the pulse width to an intermediate level if the temperature of the thermal head is substantially identical to the prescribed thermal head temperature and increasing the pulse width if the temperature of the thermal head is lower than the prescribed thermal head temperature. Further, the fuzzy inference portion is so formed as to control the pulse width to two levels by slightly reducing the pulse width if the printing ambient temperature is higher than a prescribed printing ambient temperature (ambient temperature) and slightly increasing the pulse width if the printing ambient temperature is lower than the prescribed printing ambient temperature. The fuzzy inference portion can suppress dispersion of the printing concentration by selecting any of the five pulse width levels in response to the temperature of the thermal head and the printing ambient temperature (ambient temperature).

Thermal head control means described in the aforementioned Japanese Patent Laying-Open No. 6-238939 reduces influence exerted by the ambient temperature by detecting the ambient temperature with ambient temperature detection means and controlling an applied voltage and/or an electrification time to three printing conditions by applying a prescribed voltage for a prescribed electrification time if the ambient temperature is within a previously set reference temperature range, reducing the applied voltage below the voltage applied when the ambient temperature is within the reference temperature range if the ambient temperature is higher than the reference temperature range and increasing the electrification time from that employed when the ambient temperature is within the reference temperature range if the ambient temperature is lower than the reference temperature range.

Thermal head control means described in the aforementioned Japanese Patent Laying-Open No. 10-217529 is provided with a temperature measuring apparatus for acquiring the temperature of a thermal head, for determining unprintableness if the temperature of the thermal head exceeds a reference value and interrupting printing until the temperature of the thermal head is reduced to a printing start temperature allowing printing initiation. According to Japanese Patent Laying-Open No. 10-217529, the printing start temperature allowing printing initiation, calculated on the basis of the quantity of printing, is increased if the quantity of printing is small, so that the printing can be returned in an early stage.

However, the thermal head control means described in the aforementioned Japanese Patent Laying-Open No. 5-155059 controls the electrification time in consideration of only the ambient temperature of the image generating apparatus, regardless of temperature rise resulting from continuous service of the thermal head. When the thermal head is continuously used for continuously printing the same image, therefore, it is difficult to supply a proper heat quantity to the thermal head. Therefore, printing quality is disadvantageously remarkably dispersed in an initial stage of continuously printing the same image and after printing this image on a constant number of papers.

In the thermal head control means described in the aforementioned Japanese Patent Laying-Open No. 6-297748 controlling the printing concentration by selecting the pulse width from the two levels in relation to the printing ambient temperature (ambient temperature), the printing concentration cannot be correctly controlled to levels beyond the two levels if the ambient temperature fluctuates. If the ambient temperature fluctuates when the image generating apparatus continuously prints the same image, therefore, it is disadvantageously difficult to sufficiently reduce dispersion of the printing quality between an initial stage of continuously printing the same image and after printing this image on a constant number of papers.

In the thermal head control means described in the aforementioned Japanese Patent Laying-Open No. 6-238939 controlling the applied voltage and/or the electrification time to the three printing conditions on the basis of comparison between the ambient temperature and the reference temperature range, the applied voltage and/or the electrification time cannot be correctly controlled to printing conditions beyond the three conditions. If the ambient temperature fluctuates when the image generating apparatus continuously prints the same image, therefore, it is disadvantageously difficult to sufficiently reduce dispersion of the printing quality between an initial stage of continuously printing the same image and after printing this image on a constant number of papers.

The aforementioned Japanese Patent Laying-Open No. 10-217529, disclosing the thermal head control means calculating the printing start temperature allowing printing initiation from the quantity of printing, discloses no technique of correcting the printing concentration on the basis of the ambient temperature or the like. If the ambient temperature fluctuates when the image generating apparatus continuously prints the same image, therefore, the printing quality is disadvantageously increased between an initial stage of continuously printing the same image and after printing this image on a constant number of papers.

SUMMARY OF THE INVENTION

The present invention has been proposed in order to solve the aforementioned problems, and an object of the present invention is to provide an image generating apparatus capable of stabilizing printing quality by sufficiently reducing dispersion of the printing quality between an initial stage of continuously printing the same image and after printing this image on a constant number of papers.

In order to attain the aforementioned object, an image generating apparatus according to a first aspect of the present invention comprises a thermal head for printing a print image, an apparatus body storing the thermal head, a first temperature sensor for detecting the temperature of the thermal head, a second temperature sensor for detecting an ambient temperature indicating the temperature of the atmosphere in the apparatus body and a control portion printing the print image by predicting an ambient temperature in the apparatus body substantially reaching a constant level after continuously printing the same print image from the data quantity of the print image and adding a heat quantity corresponding to the difference between a predicted ambient temperature in the apparatus body and a printing-time ambient temperature in the apparatus body detected by the second temperature sensor to a heat quantity of the thermal head decided in response to a printing-time temperature of the thermal head detected by the first temperature sensor.

As hereinabove described, the image generating apparatus according to the first aspect is provided with the control portion printing the print image by predicting the ambient temperature in the apparatus body substantially reaching the constant level after continuously printing the same print image from the data quantity of the print image and adding the heat quantity corresponding to the difference between the predicted ambient temperature in the apparatus body and the printing-time ambient temperature in the apparatus body detected by the second temperature sensor to the heat quantity of the thermal head for supplying a heat quantity for the same ambient temperature as that substantially reaching the constant level after performing continuous printing on a constant number of papers in an initial stage of continuously printing the same image, thereby sufficiently reducing dispersion of the printing quality in the initial stage of continuous printing and after performing printing on the constant number of papers. Further, the control portion, so formed as to perform printing in consideration of not only the heat quantity based on the aforementioned ambient temperature but also the heat quantity of the thermal head decided in response to the printing-time temperature of the thermal head detected by the first temperature sensor, can suppress influence exerted on the printing quality by the temperature of the thermal head, thereby sufficiently reducing dispersion of the printing quality in the initial stage of continuous printing and after performing printing on the constant number of papers.

The aforementioned image generating apparatus according to the first aspect preferably further comprises a previously created first table defining the relation between data quantities and the predicted ambient temperature in the apparatus body, while the control portion is preferably so formed as to predict the ambient temperature in the apparatus body substantially reaching the constant level after continuous printing from the data quantity of the print image on the basis of the first table. According to this structure, the control portion can predict the ambient temperature in the apparatus body responsive to the data quantity, thereby correctly predicting the ambient temperature substantially reaching the constant level after performing continuous printing with the data quantity. Thus, the error between the predicted ambient temperature and the actual ambient temperature substantially reaching the constant level can be sufficiently reduced for further sufficiently reducing dispersion of the printing quality in the initial stage of continuous printing and after performing printing on the constant number of papers.

The aforementioned image generating apparatus comprising the first table preferably further comprises a second table defining the relation between the temperature of the thermal head and heat quantities supplied to the thermal head, while the control portion is preferably so formed as to decide the heat quantity supplied to the thermal head through the second table with a value obtained by subtracting the difference between the predicted ambient temperature in the apparatus body and the printing-time ambient temperature in the apparatus body detected by the second temperature sensor from the temperature of the thermal head detected by the first temperature sensor. According to this structure, the heat quantity supplied to the thermal head can be easily decided in consideration of both of the ambient temperature data in the apparatus body and the temperature data of the thermal head.

In this case, the first table and the second table are preferably individually provided for the respective ones of the three primary colors of object color. According to this structure, the heat quantity supplied to the thermal head can be decided on the basis of the data quantities of the three primary colors of object color, thereby sufficiently reducing dispersion of the printing quality in the initial stage of continuous printing and after performing printing on the constant number of papers for the respective colors. Thus, the printing quality can be further stabilized.

In the aforementioned image generating apparatus comprising the first table, the first table is preferably created by measuring the ambient temperature in the apparatus body every print number when continuously printing each of print images of different data quantities on a plurality of papers thereby deciding the ambient temperature in the apparatus body substantially reaching the constant level after continuous printing on a plurality of papers, thereafter plotting the relation between each data quantity and the ambient temperature in the apparatus body substantially reaching the constant level after continuous printing every data quantity, calculating the relational expression of an approximate line on the basis of plotted points and defining the relation between each data quantity and the predicted ambient temperature in the apparatus body from the relational expression of the approximate line. According to this structure, the predicted ambient temperature in the apparatus body can be calculated also as to an unplotted data quantity, whereby the first table can be detailedly created.

The aforementioned image generating apparatus having the first table defining the relation between each data quantity and the predicted ambient temperature in the apparatus body preferably calculates the ambient temperature in the apparatus body substantially reaching the constant level after continuous printing on a plurality of papers through the relational expression of an approximate line based on the ambient temperature in the apparatus body every print number. According to this structure, the ambient temperature in the apparatus body substantially reaching the constant level can be easily obtained without actual printing when printing is continuously performed on a large number of papers, by calculating the ambient temperature in the apparatus body substantially reaching the constant level in the aforementioned manner.

In the aforementioned image generating apparatus having the first table defining the relation between each data quantity and the predicted ambient temperature in the apparatus body, the ambient temperature in the apparatus body substantially reaching the constant level after continuous printing preferably includes the ambient temperature in the apparatus body for the maximum number of continuously printable papers.

According to this structure, the printing quality in the initial stage of printing can be matched with printing quality for the maximum number of continuously printable papers.

In the aforementioned image generating apparatus according to the first aspect, the second temperature sensor is preferably arranged on a region, corresponding to the thermal head, located above the thermal head. According to this structure, the ambient temperature around the thermal head can be so detected as to correctly obtain the heat quantity supplied to the thermal head.

In the aforementioned image generating apparatus according to the first aspect, the thermal head preferably includes a plurality of heating elements so arranged as to linearly extend in a direction perpendicular to a paper carrying direction, and the data quantity of the print image is preferably calculated by multiplying the product of the number of the heating elements and the number of columns printed by the linearly arranged heating elements on the paper in the paper carrying direction by the number of gradations of the heating elements. According to this structure, the heat quantity supplied to the overall paper can be easily obtained.

An image generating apparatus according to a second aspect of the present invention comprises a thermal head for printing a print image, an apparatus body storing the thermal head, a first temperature sensor for detecting the temperature of the thermal head, a second temperature sensor for detecting an ambient temperature indicating the temperature of the atmosphere in the apparatus body, a previously created first table defining the relation between data quantities and a predicted ambient temperature in the apparatus body, a second table defining the relation between the temperature of the thermal head and heat quantities supplied to the thermal head and a control portion printing the print image by predicting an ambient temperature in the apparatus body substantially reaching a constant level after continuously printing the same print image from the data quantity of the print image and adding a heat quantity corresponding to the difference between the predicted ambient temperature in the apparatus body and a printing-time ambient temperature in the apparatus body detected by the second temperature sensor to a heat quantity of the thermal head decided in response to a printing-time temperature of the thermal head detected by the first temperature sensor, while the control portion is so formed as to predict the ambient temperature in the apparatus body substantially reaching the constant level after continuous printing from the data quantity of the print image on the basis of the first table for deciding a heat quantity supplied to the thermal head through the second table with a value obtained by subtracting the difference between the predicted ambient temperature in the apparatus body and the printing-time ambient temperature in the apparatus body detected by the second temperature sensor from the temperature of the thermal head detected by the first temperature sensor, the first table and the second table are individually provided for the respective ones of the three primary colors of object color, and the first table is created by measuring the ambient temperature in the apparatus body every print number when continuously printing each of print images of different data quantities on a plurality of papers thereby deciding the ambient temperature in the apparatus body substantially reaching the constant level after continuous printing on a plurality of papers, thereafter plotting the relation between each data quantity and the ambient temperature in the apparatus body substantially reaching the constant level after continuous printing every data quantity, calculating the relational expression of an approximate line on the basis of plotted points and defining the relation between each data quantity and the predicted ambient temperature in the apparatus body from the relational expression of the approximate line.

As hereinabove described, the image generating apparatus according to the second aspect is provided with the control portion printing the print image by predicting the ambient temperature in the apparatus body substantially reaching the constant level after continuously printing the same print image from the data quantity of the print image and adding the heat quantity corresponding to the difference between the predicted ambient temperature in the apparatus body and the printing-time ambient temperature in the apparatus body detected by the second temperature sensor to the heat quantity of the thermal head for supplying a heat quantity for the same ambient temperature as that substantially reaching the constant level after performing continuous printing on a constant number of papers in an initial stage of continuously printing the same image, thereby sufficiently reducing dispersion of the printing quality in the initial stage of continuous printing and after performing printing on the constant number of papers. Further, the control portion, so formed as to perform printing in consideration of not only the heat quantity based on the aforementioned ambient temperature but also the heat quantity of the thermal head decided in response to the printing-time temperature of the thermal head detected by the first temperature sensor, can suppress influence exerted on the printing quality by the temperature of the thermal head, thereby sufficiently reducing dispersion of the printing quality in the initial stage of continuous printing and after performing printing on the constant number of papers.

According to the second aspect, further, the control portion, so formed as to predict the ambient temperature in the apparatus body substantially reaching the constant level after continuous printing from the data quantity of the print image on the basis of the first table, can predict the ambient temperature in the apparatus body responsive to the data quantity, thereby correctly predicting the ambient temperature substantially reaching the constant level after performing continuous printing with the data quantity. Thus, the error between the predicted ambient temperature and the actual ambient temperature substantially reaching the constant level can be sufficiently reduced for further sufficiently reducing dispersion of the printing quality in the initial stage of continuous printing and after performing printing on the constant number of papers. Further, the control portion is so formed as to decide the heat quantity supplied to the thermal head through the second table with the value obtained by subtracting the difference between the predicted ambient temperature in the apparatus body and the printing-time ambient temperature in the apparatus body detected by the second temperature sensor from the temperature of the thermal head detected by the first temperature sensor, whereby the heat quantity supplied to the thermal head can be easily decided in consideration of both of the ambient temperature data in the apparatus body and the temperature data of the thermal head.

According to the second aspect, the first table and the second table are individually provided for the respective ones of the three primary colors of object color so that the heat quantity supplied to the thermal head can be decided on the basis of the data quantities of the three primary colors of object color, thereby sufficiently reducing dispersion of the printing quality in the initial stage of continuous printing and after performing printing on the constant number of papers for the respective colors. Thus, the printing quality can be further stabilized. Further, the first table is created by measuring the ambient temperature in the apparatus body every print number when continuously printing each of print images of different data quantities on a plurality of papers thereby deciding the ambient temperature in the apparatus body substantially reaching the constant level after continuous printing on a plurality of papers, thereafter plotting the relation between each data quantity and the ambient temperature in the apparatus body substantially reaching the constant level after continuous printing every data quantity and calculating the relational expression of an approximate line on the basis of plotted points and defining the relation between each data quantity and the predicted ambient temperature in the apparatus body from the relational expression of the approximate line so that the predicted ambient temperature in the apparatus body can be calculated also as to an unplotted data quantity, whereby the first table can be detailedly created.

The aforementioned image generating apparatus according to the second aspect preferably calculates the ambient temperature in the apparatus body substantially reaching the constant level after continuous printing on a plurality of papers through the relational expression of an approximate line based on the ambient temperature in the apparatus body every print number. According to this structure, the ambient temperature in the apparatus body substantially reaching the constant level can be easily obtained without actual printing when printing is continuously performed on a large number of papers, by calculating the ambient temperature in the apparatus body substantially reaching the constant level in the aforementioned manner.

In the aforementioned image generating apparatus according to the second aspect, the ambient temperature in the apparatus body substantially reaching the constant level after continuous printing preferably includes the ambient temperature in the apparatus body for the maximum number of continuously printable papers. According to this structure, the printing quality in the initial stage of printing can be matched with printing quality for the maximum number of continuously printable papers.

In the aforementioned image generating apparatus according to the second aspect, the second temperature sensor is preferably arranged on a region, corresponding to the thermal head, located above the thermal head. According to this structure, the ambient temperature around the thermal head can be so detected as to correctly obtain the heat quantity supplied to the thermal head.

In the aforementioned image generating apparatus according to the second aspect, the thermal head preferably includes a plurality of heating elements so arranged as to linearly extend in a direction perpendicular to a paper carrying direction, and the data quantity of the print image is preferably calculated by multiplying the product of the number of the heating elements and the number of columns printed by the linearly arranged heating elements on the paper in the paper carrying direction by the number of gradations of the heating elements. According to this structure, the heat quantity supplied to the overall paper can be easily obtained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a thermal transfer printer employed as an image generating apparatus according to this embodiment is described with reference to FIGS. 1 to 10. The thermal transfer printer according to this embodiment is capable of printing colors of 0 to 255 gradations.

Figure 1:
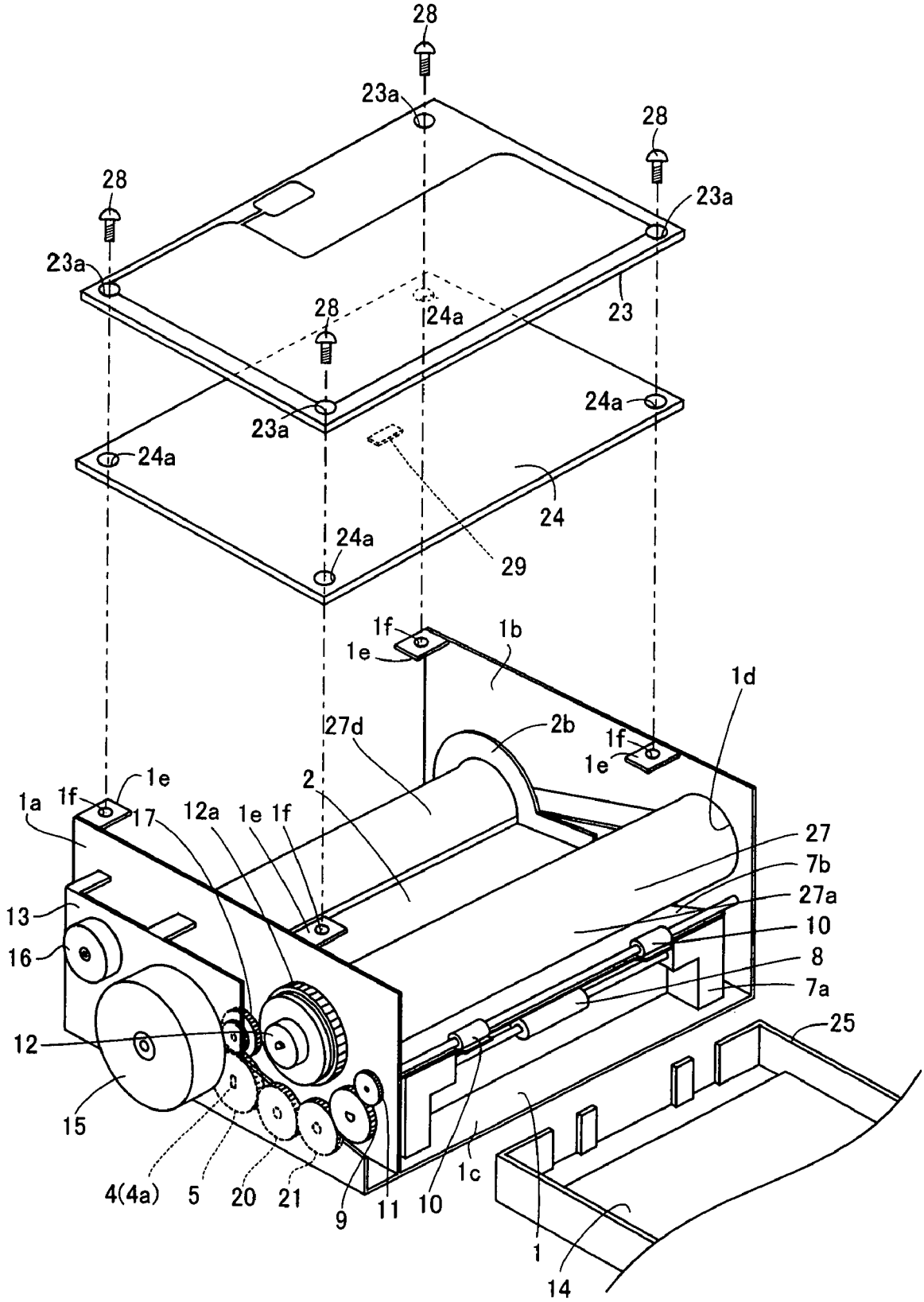
FIG. 1 is a perspective view showing the overall structure of a thermal transfer printer (image generating apparatus) according to an embodiment of the present invention.
Figure 2:
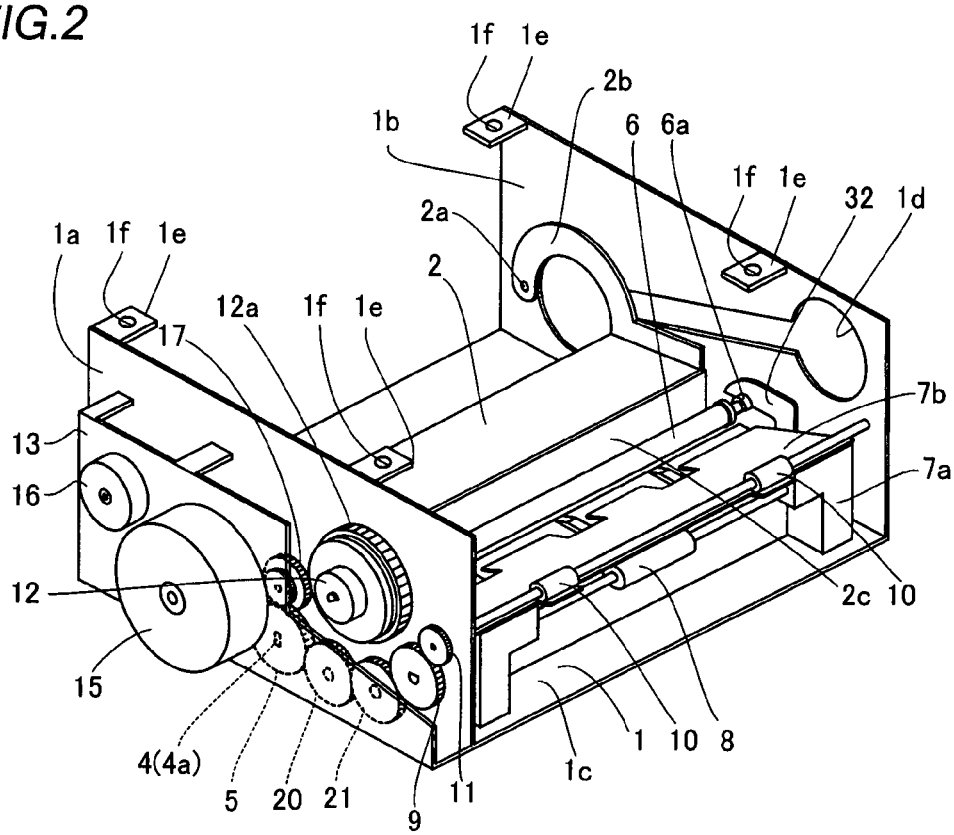
FIG. 2 is a perspective view showing a printer body of the thermal transfer printer according to the embodiment shown in FIG. 1.
Figure 3:
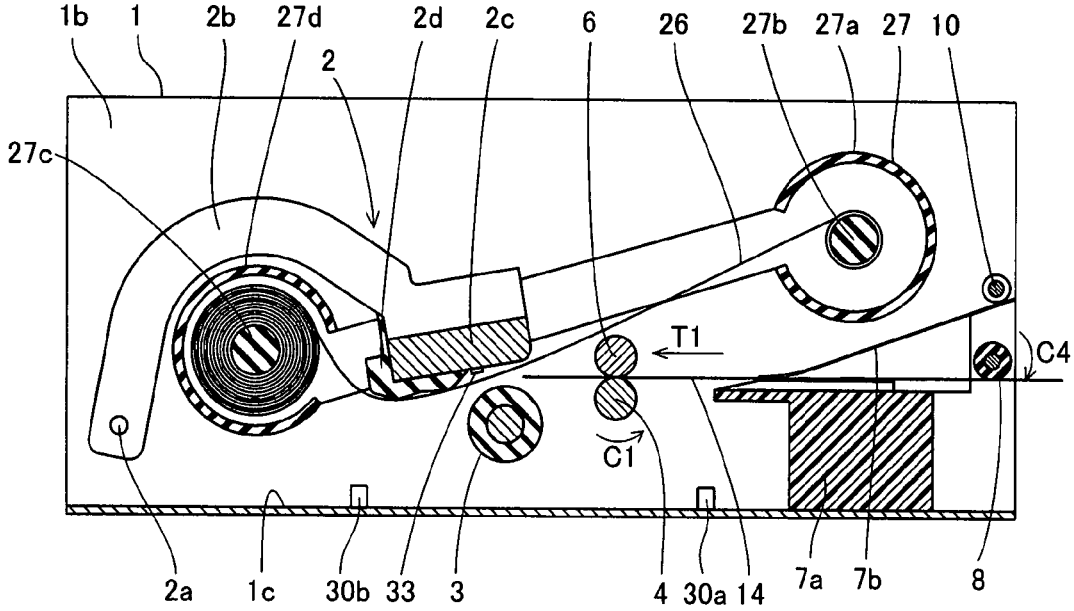
FIG. 3 is a sectional view of the thermal transfer printer according to the embodiment shown in FIG. 1.

The body of the thermal transfer printer according to this embodiment comprises a chassis 1 of metal, a thermal head 2 for performing printing, a platen roller 3 (see FIG. 3) opposed to the thermal head 2, a feed roller 4 (see FIG. 3) of metal, a feed roller gear 5, a press roller 6 (see FIG. 3) of metal pressing the feed roller 4 with prescribed pressing force, a lower paper guide 7*a* of resin, an upper paper guide 7*b* of resin, a paper feed roller 8 of rubber, a paper feed roller gear 9, a paper discharge roller 10 of rubber, a paper discharge roller gear 11, an ink sheet take-up reel 12, a motor bracket 13, a motor 15 for carrying each paper 14 (see FIG. 1), another motor 16 rotating the thermal head 2, a swingable swing gear 17, a plurality of intermediate gears 18 to 21 (see FIG. 5), a circuit portion 22 (see FIG. 4) controlling operations of the thermal transfer printer, a wiring board 23 provided with the circuit portion 22 controlling the operations of the thermal transfer printer and a top plate 24, as shown in FIGS. 1 to 3. In order to perform printing, a paper tray 25 (see FIG. 1) provided in correspondence to each of a plurality of sizes of papers 14 (see FIG. 1) and an ink sheet cartridge 27 (see FIG. 1) provided in correspondence to an ink sheet 26 (see FIG. 3) corresponding to each of the plurality of sizes of papers 14 are set on the thermal transfer printer according to this embodiment.

The chassis 1 has a first side surface 1*a*, a second side surface 1*b* and a bottom surface 1*c*, as shown in FIGS. 1 and 2. The aforementioned motor bracket 13 is mounted on the first side surface 1*a* of the chassis 1. The second side surface 1*b* of the chassis 1 is provided with a receiving hole 1*d* for receiving the ink sheet cartridge 27, as shown in FIGS. 1 and 2. Two pairs of mounting portions 1*e* for mounting the wiring board 23 are formed on the upper ends of the first and second side surfaces 1*a* and 1*b* respectively. The mounting portions 1*e* are provided with threaded holes 1*f* meshing with screws 28 for fixing the wiring board 23 and the top plate 24 to each other. The top plate 24 is provided with screw receiving holes 24*a* mounted on the mounting portions 1*e* provided on the chassis 1 through screws 28 respectively and an ambient temperature sensor 29 for detecting an ambient temperature indicating the temperature of the working atmosphere of the thermal transfer printer. This ambient temperature sensor 29 is arranged above the region provided with the thermal head 2 at a prescribed interval. The ambient temperature sensor 29 is an example of the "second temperature sensor" in the present invention. The wiring board 23 is provided with screw receiving holes 23*a* mounted on the mounting portions 1*e* provided on the chassis 1 respectively. As shown in FIG. 3, paper sensors 30*a* and 30*b* for detecting the front and rear ends of each paper 14 are provided on the bottom surface 1*c* of the chassis 1.

Figure 6:
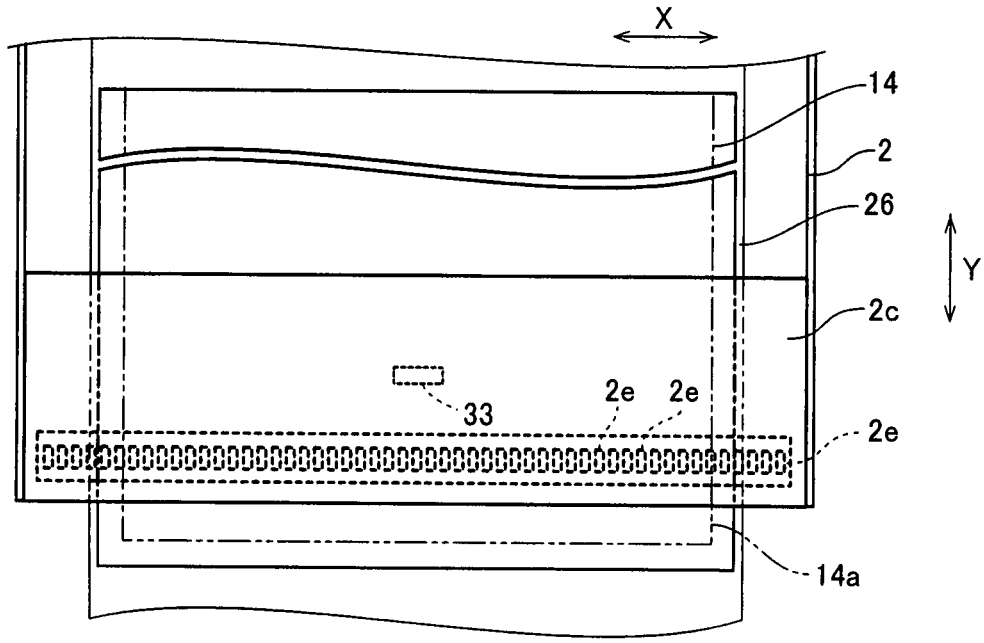
FIG. 6 is a plan view showing a portion around a thermal head of the thermal transfer printer according to the embodiment shown in FIG. 1.
Figure 8:
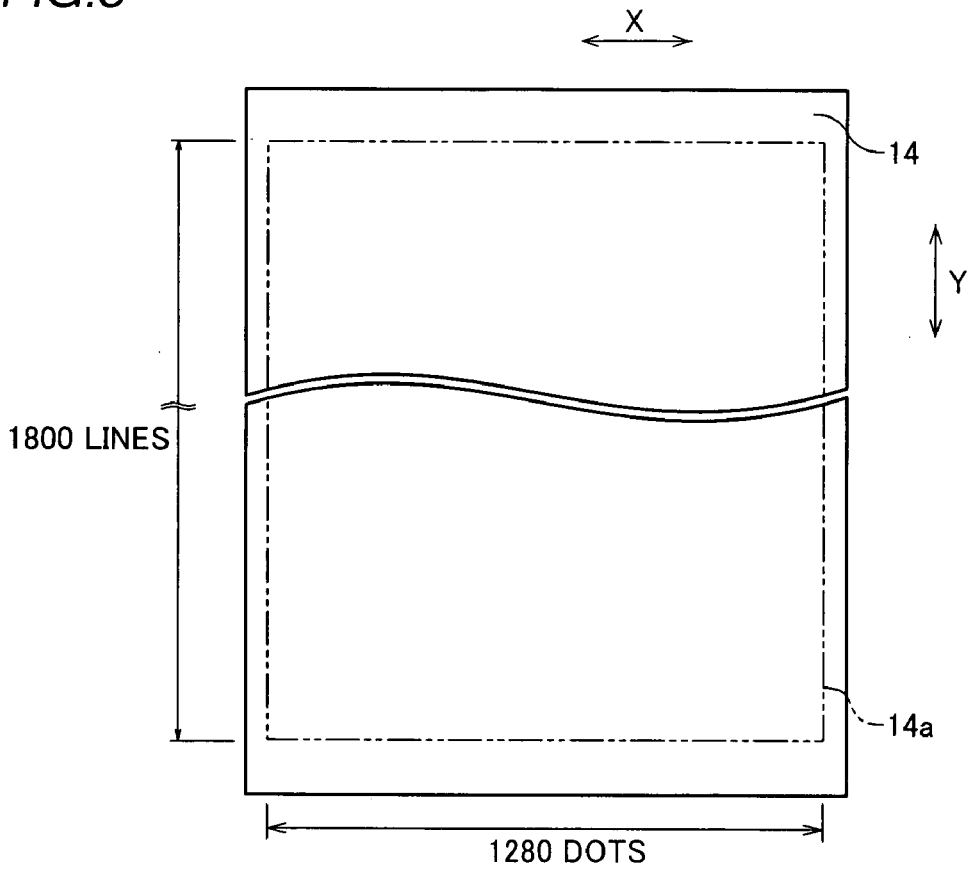
FIG. 8 is a plan view showing a paper used for the thermal transfer printer according to the embodiment shown in FIG. 1.

The thermal head 2 includes a support shaft 2*a*, an arm portion 2*b*, a head portion 2*c* and a head cover 2*d* of resin mounted on the head portion 2*c*. The thermal head 2*c* is mounted inside the first and second side surfaces 1*a* and 1*b* of the chassis 1 to be rotatable about the support shaft 2*a*. The head portion 2*c* of the thermal head 2 is provided with a plurality of heating elements 2*e* generating heat through application of voltage pulses for heating the ink sheet 26 and transferring an ink from the ink sheet 26 to a print area 14*a* of each paper 14, as shown in FIG. 6. The plurality of heating elements 2*e* are aligned with each other in a direction X perpendicular to a paper feed direction (direction Y) at prescribed intervals. Each heating element 2*e* prints an image of one dot on each paper 14, while the aligned heating elements 2*e* print an image of one line on the paper 14. The print area 14*a* of the paper 14 employed for the thermal transfer printer according to this embodiment has 1280 dots in the direction X (perpendicular to the paper feed direction Y) and 1800 lines in the direction Y (paper feed direction), as shown in FIG. 8. A head temperature sensor 33 for detecting the temperature of the thermal head 2 is provided on the bottom surface of the thermal head 2 in the vicinity of the heating elements 2*e*, as shown in FIG. 6. The head temperature sensor 33 is an example of the "first temperature sensor" in the present invention.

The platen roller 3 (see FIG. 3) is rotatably arranged inside the first and second side surfaces 1*a* and 1*b* of the chassis 1. The feed roller 4 has a feed roller gear insert portion 4*a* inserted into the feed roller gear 5, as show in FIG. 5. This feed roller 4 is rotatably supported by a feed roller bearing (not shown) mounted on the chassis 1. A press roller bearing 6*a* rotatably supports the press roller 6, as show in FIG. 2. This press roller bearing 6*a* is mounted on a bearing support plate 32. This bearing support plate 32 is arranged inside the first and side second surfaces 1*a* and 1*b* of the chassis 1 to press the press roller 6 against the feed roller 4 (see FIG. 3) with urging force by a spring (not shown).

Figure 5:
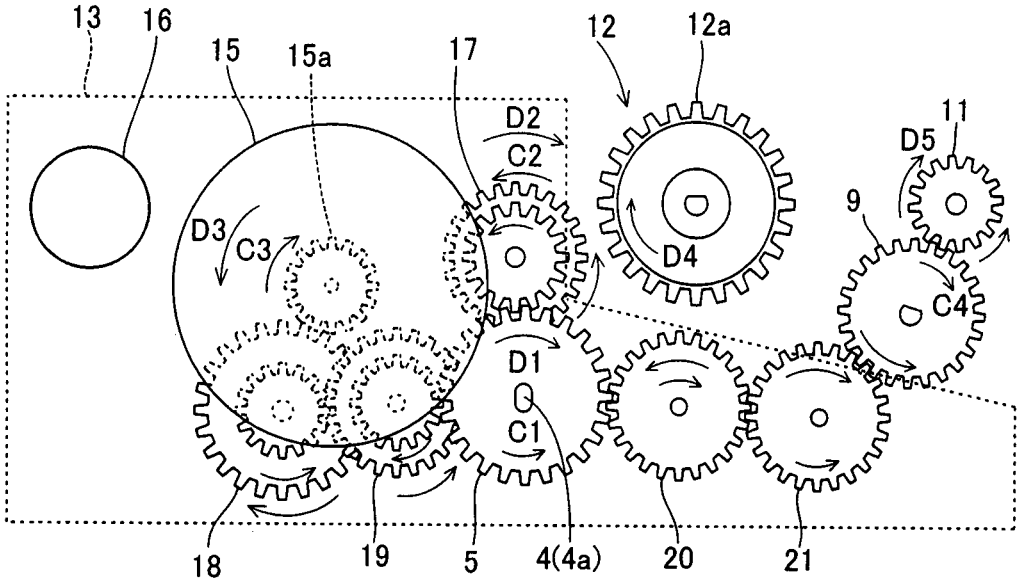
FIG. 5 is a side elevational view showing arrangement of gears included in the thermal transfer printer according to the embodiment shown in FIG. 1.

As shown in FIG. 5, a motor gear 15*a* is mounted on the shaft portion of the motor 15 mounted on the motor bracket 13. The motor 15 functions as a drive source for driving a gear portion 12*a* of the ink sheet take-up reel 12, the paper feed roller gear 9, the paper discharge roller gear 11 and the feed roller gear 5. The motor 16 functions as a drive source for a pressing member (not shown) pressing the upper surface of the thermal head 2 (see FIG. 3), for pressing the thermal head 2 against the platen roller 3 (see FIG. 3).

The ink sheet take-up reel 12 is so formed as to take up the ink sheet 26 on a take-up bobbin 27*b* by engaging with the take-up bobbin 27*b* rotatably arranged in a take-up portion 27*a* of the ink sheet cartridge 27, as shown in FIG. 3. The gear portion 12*a* of the ink sheet take-up reel 12 is so arranged as to engage with the swing gear 17 upon swinging thereof.

The lower paper guide 7*a* is set in the vicinity of the feed roller 4 (see FIG. 3) and the press roller 6, as shown in FIGS. 2 and 3. The upper paper guide 7*b* is mounted on an upper portion of the lower paper guide 7*a*, as shown in FIG. 3. This upper paper guide 7*b* has a function of guiding each paper 14 to a paper feed passage toward a printing portion through the lower surface thereof in paper feeding while guiding each paper 14 to a paper discharge passage through the upper surface thereof in paper discharge.

Figure 7:
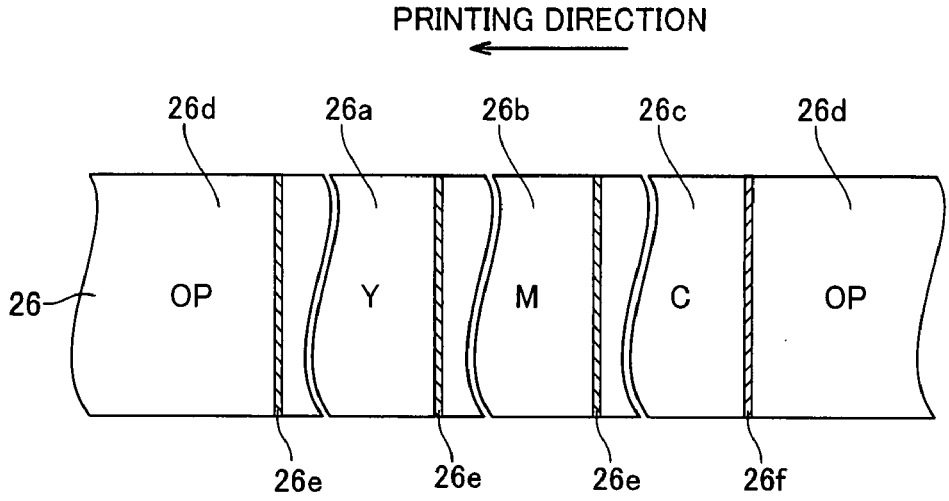
FIG. 7 is a plan view showing an ink sheet used for the thermal transfer printer according to the embodiment shown in FIG. 1.

The ink sheet cartridge 27 is provided with a supply portion 27*d* having a supply bobbin 27*c* wound with the ink sheet 26 rotatably arranged therein. This ink sheet 26 has three color sheets including a color Y (yellow) printing sheet 26*a*, a color M (magenta) printing sheet 26*b* and a color C (cyan) printing sheet 26*c* as well as a transparent OP (overcoat) sheet 26*d* for protecting a printed surface of each paper 14, as shown in FIG. 7. Identification portions 26*e* identified by a sheet search sensor (not shown) are provided between the OP (overcoat)

sheet 26*d* and the color Y (yellow) printing sheet 26*a*, between the color Y (yellow) printing sheet 26*a* and the color M (magenta) printing sheet 26*b* and between the color M (magenta) printing sheet 26*b* an the color C (cyan) printing sheet 26*c* respectively. A further identification portion 26*f* identified by the sheet search sensor (not shown) is provided between the color C (cyan) printing sheet 26*c* and the OP (overcoat) sheet 26*d*.

Figure 4:
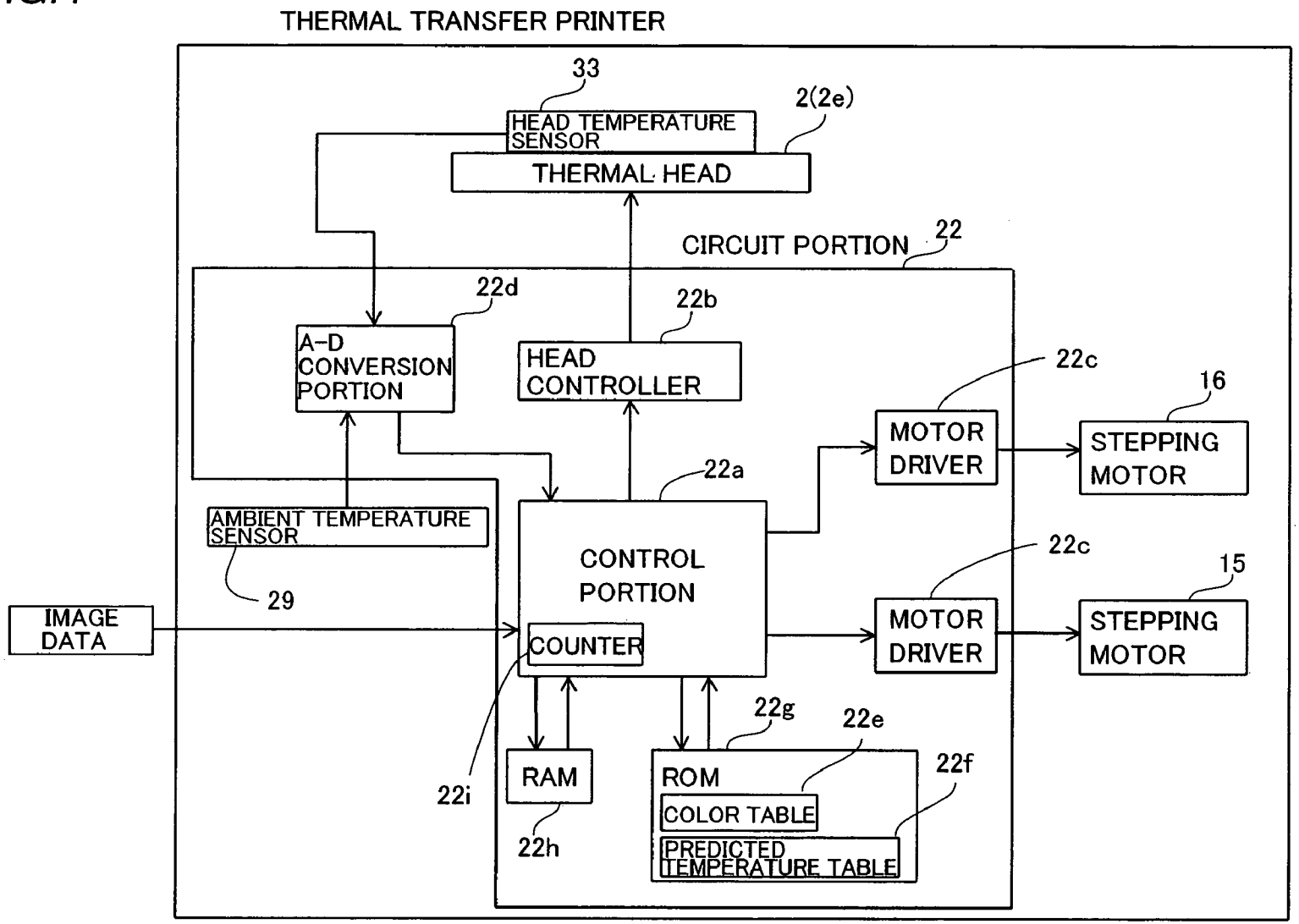
FIG. 4 is a block diagram showing the circuit structure of a circuit portion included in the thermal transfer printer according to the embodiment shown in FIG. 1.

As shown in FIG. 4, the circuit portion 22 includes a control portion 22*a* having a counter 22*i*, a head controller 22*b*, a motor driver 22*c*, an A-D conversion portion 22*d*, a ROM 22*g* storing a color table 22*e* and a predicted temperature table 22*f* and a RAM 22*h* for developing the color table 22*e* and temporarily preserving a temperature value obtained by subtracting the ambient temperature in the thermal transfer printer from a predicted temperature selected from the predicted temperature table 22*f*. The color table 22*e* is an example of the "second table" in the present invention, and the predicted temperature table 22*f* is an example of the "first table" in the present invention. The control portion 22*a* has a function of controlling the overall printing operation. The head controller 22*b* has a function of applying the voltage pulses to the heating elements 2*e* of the thermal head 2. The motor driver 22*c* has a function of controlling the motors 15 and 16. The A-D conversion portion 22*d* has a function of converting analog voltage values detected by the head temperature sensor 33 provided in the vicinity of the heating elements 2*e* of the thermal head 2 and the ambient temperature sensor 29 provided on the top plate 24 to digital values. The counter 22*i* has a function of counting the numbers of the lines (l) and the dots (i) of each paper 14 (see FIG. 8).

Figures 9, 10:
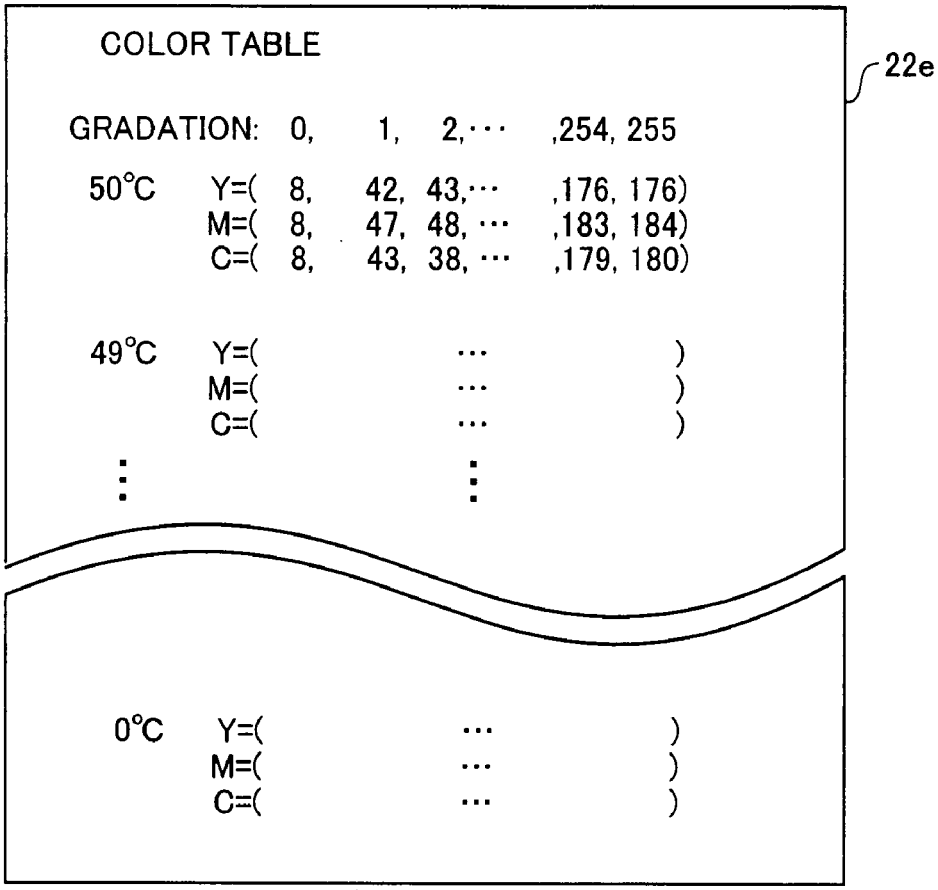
FIG. 9 illustrates a color table stored in the thermal transfer printer according to the embodiment shown in FIG. 1.
FIG. 10 illustrates a predicted temperature table used for the thermal transfer printer according to the embodiment shown in FIG. 1.

As shown in FIG. 9, the color table 22*e* stores a plurality of application data (pulse numbers of the voltage pulses) corresponding to each of the colors Y, M and C for the respective gradations (0 to 255). The color table 22*e* stores the plurality of application data every degree in the temperature range of about 0° C. to about 50° C. Referring to the color Y at a temperature of about 50° C., for example, the color table 22*e* stores the first and $256^{th}$ values "8" and "176" of Y=(8, 42, 43, . . . , 176, 176) as the application data (pulse numbers of the voltage pulses) of the gradations 0 and 255 respectively. The control portion 22*a* (see FIG. 4) controls application of the voltage pulses to the heating elements 2*e* (see FIG. 6) on the basis of the application data stored in the aforementioned color table 22*e*.

According to this embodiment, the predicted temperature table 22*f* stores predicated temperature values indicating a plurality of predicted ambient temperatures in the thermal transfer printer corresponding to each of the colors Y, M and C for the respective data quantities (divided into 70 stages), as shown in FIG. 10. The data quantities shown in FIG. 10 correspond to numerical values including the maximum 589824000 obtained by multiplying the product 2304000 (dots) of the number 1280 of the dots in the printing direction X and the number 1800 of the lines in the paper feed direction Y by the number 256 of the gradations of the colors, as shown in FIG. 8. This maximum 589824000, excessively great to be handled as the data quantity, is divided by the $23^{rd}$ power ($2^{23}$) of an arbitrary constant 2 to obtain an easily handleable maximum 70 (more precisely, 70.3125). The predicted temperature table 22*f* corresponding to 70 stages of data quantities is created by dividing the data quantity having the maximum of 70 into 70 stages.

The method of creating the predicted temperature table 22*f* is now described with reference to FIGS. 9 to 18.

According to this embodiment, the temperature of the thermal head 2 and the ambient temperature of the thermal transfer printer are actually measured every paper in a case of continuously printing images of grays (gray 1, gray 2, gray 3, gray 4 and gray 5) having five types of different color tones (data quantities) on the whole surfaces of 15 papers. The grays are printed on the whole surfaces of the papers since the same can be homogeneously printed on the respective dots and the data quantities of the colors Y, M and C can be simultaneously calculated. The data quantities of the colors Y, M and C in the respective grays (gray 1 to gray 5) are previously calculated.

Figure 11:
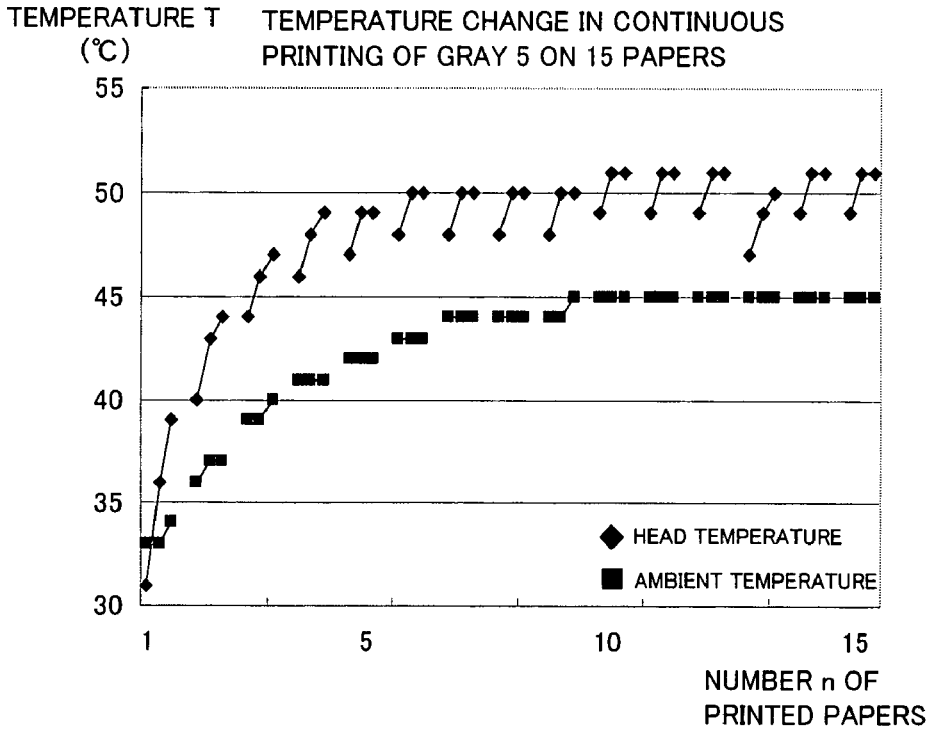
FIG. 11 is a graph showing the relation between the numbers of printed papers, head temperatures and ambient temperatures in a case of performing continuous printing in gray 5 in the thermal transfer printer according to the embodiment shown in FIG. 1.
Figure 12:
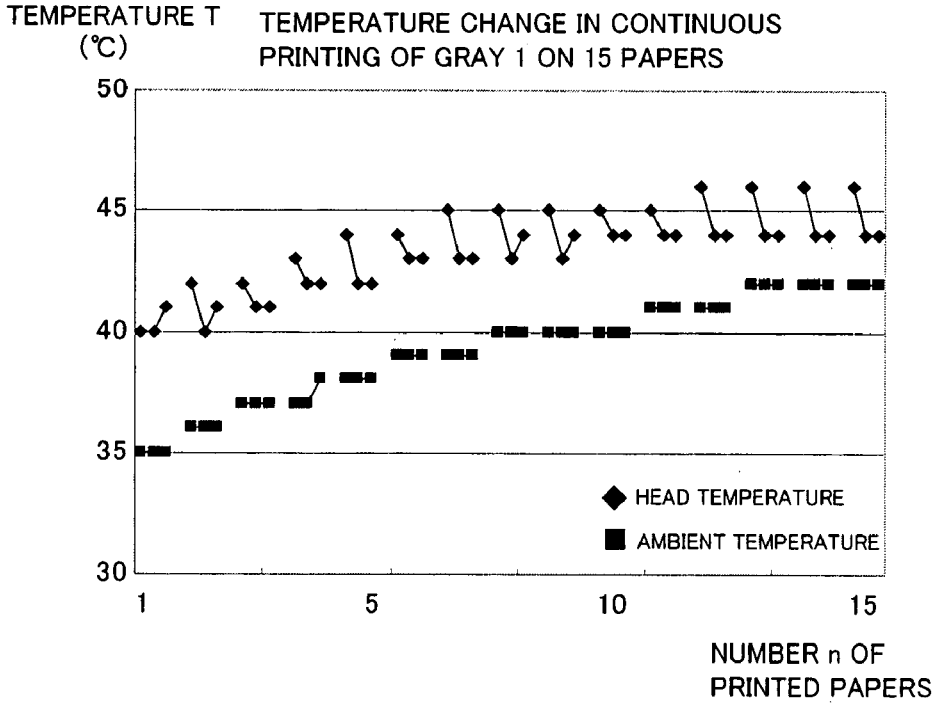
FIG. 12 is a graph showing the relation between the numbers of printed papers, head temperatures and ambient temperatures in a case of performing continuous printing in gray 1 in the thermal transfer printer according to the embodiment shown in FIG. 1.

Then, graphs are created by plotting the temperatures of the thermal head 2 and the ambient temperatures in the thermal transfer printer for the respective printing times (first to $15^{th}$) in the case of performing continuous printing with the five types of grays (gray 1, gray 2, gray 3, gray 4 and gray 5). FIGS. 11 and 12 show graphs in cases of performing continuous printing with the deepest gray (having the maximum data quantity: gray 5) and the lightest gray (having the minimum data quantity: gray 1) among the five types of grays respectively. The graphs of FIGS. 11 and 12 show temperature changes of the thermal head 2 and ambient temperature changes in the thermal transfer printer for the respective printing times with sequentially plotted three points of the colors Y, M and C as a unit (paper).

Figure 13:
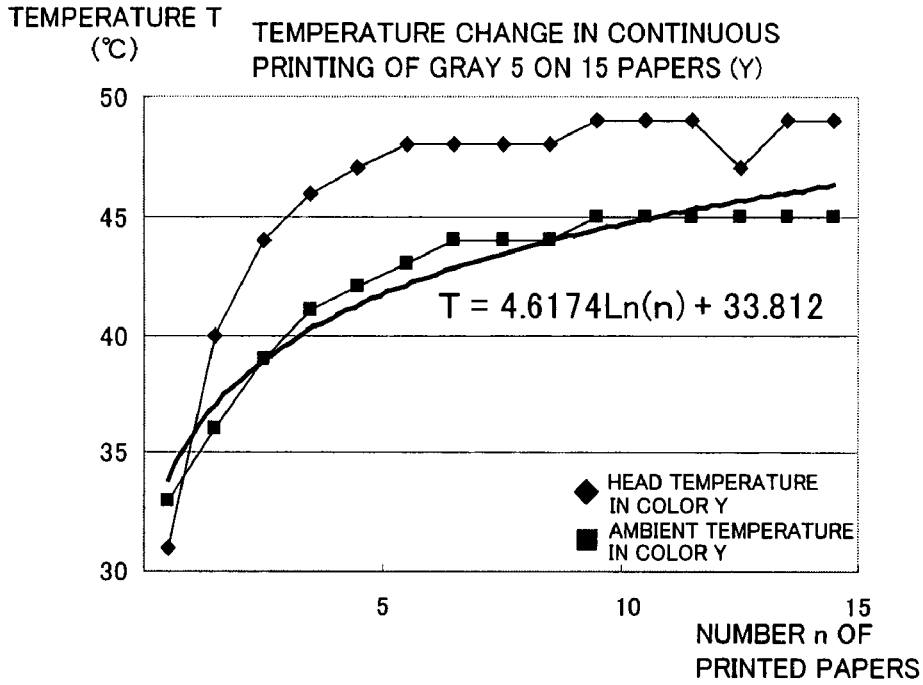
FIG. 13 is a graph showing the relation between the numbers of papers printed in color Y, head temperatures and ambient temperatures in a case of performing continuous printing in gray 5 in the thermal transfer printer according to the embodiment shown in FIG. 1.
Figure 14:
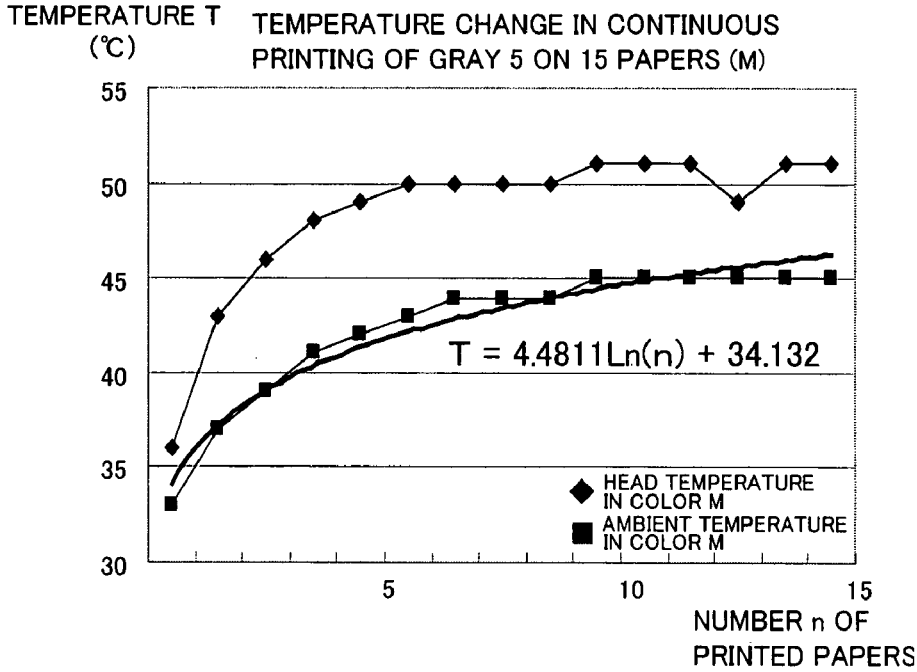
FIG. 14 is a graph showing the relation between the numbers of papers printed in color M, head temperatures and ambient temperatures in a case of performing continuous printing in gray 5 in the thermal transfer printer according to the embodiment shown in FIG. 1.
Figure 15:
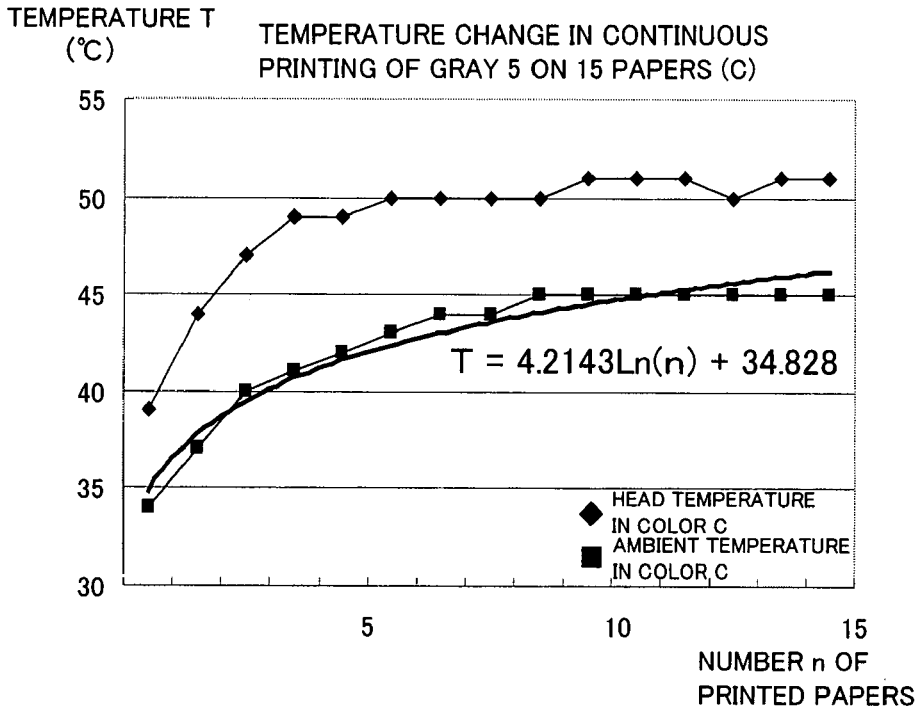
FIG. 15 is a graph showing the relation between the numbers of papers printed in color C, head temperatures and ambient temperatures in a case of performing continuous printing in gray 5 in the thermal transfer printer according to the embodiment shown in FIG. 1.

Then, the temperatures of the thermal head 2 and the ambient temperatures in the thermal transfer printer in the colors Y, M and C are picked out from the graphs for the five types of grays (gray 1 to gray 5) created in the aforementioned manner, for creating graphs showing the relations between the temperatures of the thermal head 2, the ambient temperatures and the printing times for the respective colors. Then, expressions indicating approximate lines corresponding to the plots are obtained on the basis of the plotted ambient temperatures in the thermal transfer printer for the respective colors. FIGS. 13 to 15 show the temperatures of the thermal head 2 and the ambient temperatures for the printing times as to the respective colors (colors Y, M and C) in a case of performing continuous printing in gray 5, approximate lines of the ambient temperatures and expressions indicating the approximate lines respectively. Then, predicated ambient temperatures in the thermal transfer printer in a case of performing continuous printing on 20 papers are calculated through the expressions indicating the approximate lines of the ambient temperatures for the colors Y, M and C with respect to the five types of grays (gray 1 to gray 5).

Figure 16:
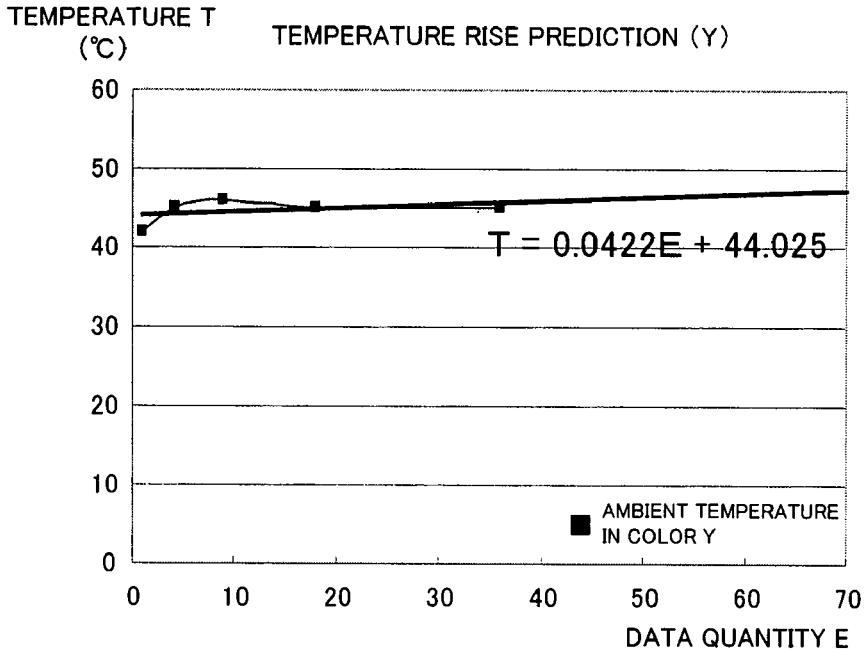
FIG. 16 is a graph showing the relation between data quantities and predicted ambient temperatures for a color Y in the thermal transfer printer according to the embodiment shown in FIG. 1.
Figure 17:
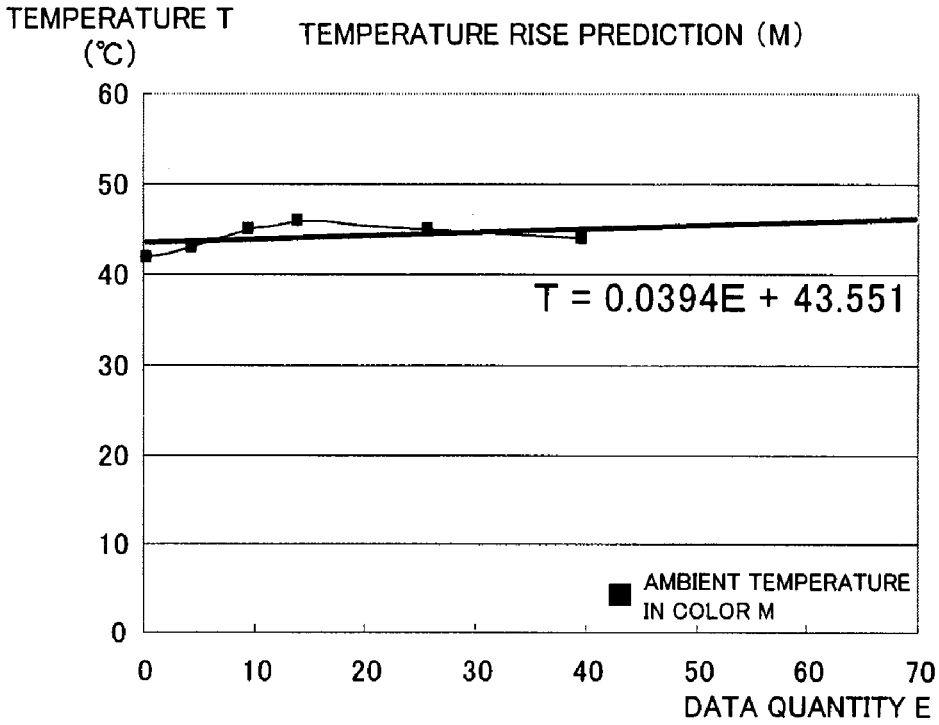
FIG. 17 is a graph showing the relation between data quantities and predicted ambient temperatures for a color M in the thermal transfer printer according to the embodiment shown in FIG. 1.
Figure 18:
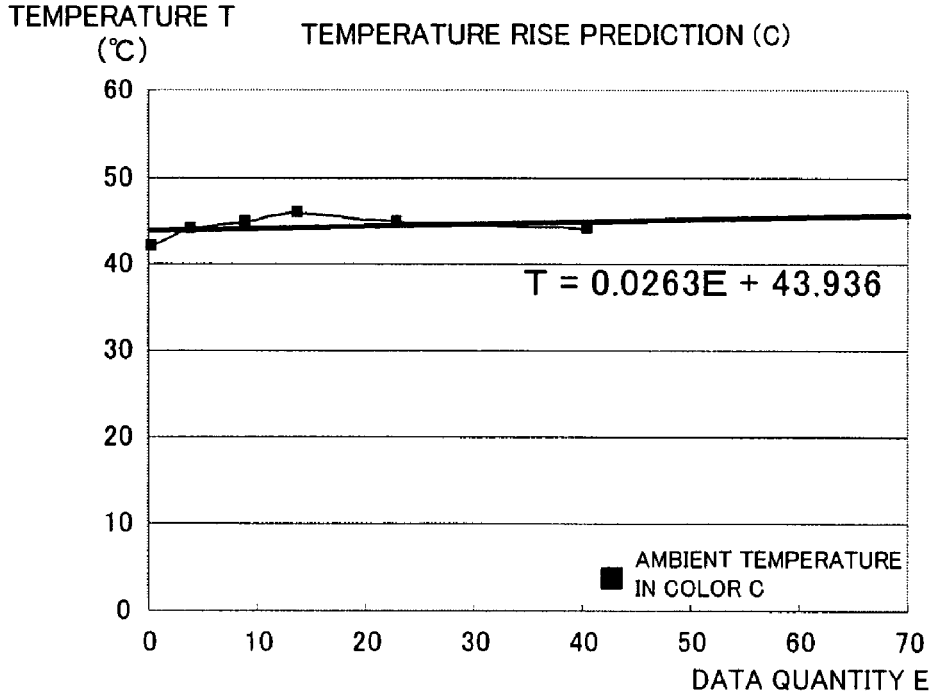
FIG. 18 is a graph showing the relation between data quantities and predicted ambient temperatures for a color C in the thermal transfer printer according to the embodiment shown in FIG. 1.

Then, the predicated ambient temperatures in the thermal transfer printer with respect to data quantities in the case of performing continuous printing on 20 papers are plotted for the colors Y, M and C respectively through the previously calculated data quantities of the colors Y, M and C in the five types of grays (gray 1 to gray 5) and the aforementioned expressions indicating the approximate lines, as shown in FIGS. 16 to 18. Then, expressions indicating approximate lines corresponding to the plots are obtained for the colors Y, M and C respectively on the basis of the predicated ambient temperatures in the thermal transfer printer in the case of performing continuous printing on 20 papers plotted for the respective data quantities.

Then, the data quantities ranging from the minimum 1 to the maximum 70 are substituted in the expressions of the approximate lines obtained from the plots showing the relations between the data quantities and the predicated ambient temperatures in the thermal transfer printer in the case of performing continuous printing on 20 papers respectively, so that predicted temperatures indicating the ambient temperatures in the thermal transfer printer corresponding to the data quantities can be obtained. Thus, the predicted temperature table 22*f* is created as shown in FIG. 10.

The printing operation of the thermal transfer printer according to this embodiment is now described with reference to FIGS. 1, 3 to 7, 9, 10 and 19 to 22.

Figure 19:
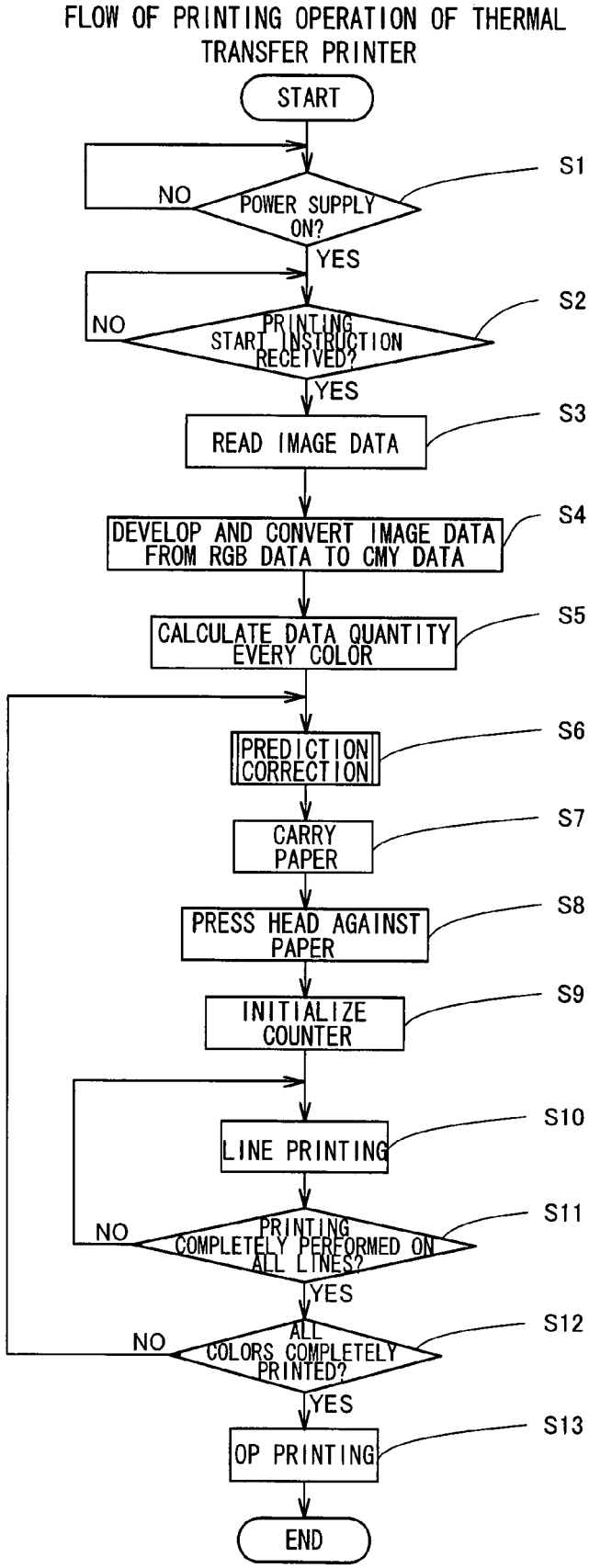
FIG. 19 is a flow chart for illustrating a printing operation of the thermal transfer printer according to the embodiment shown in FIG. 1.
Figure 20:
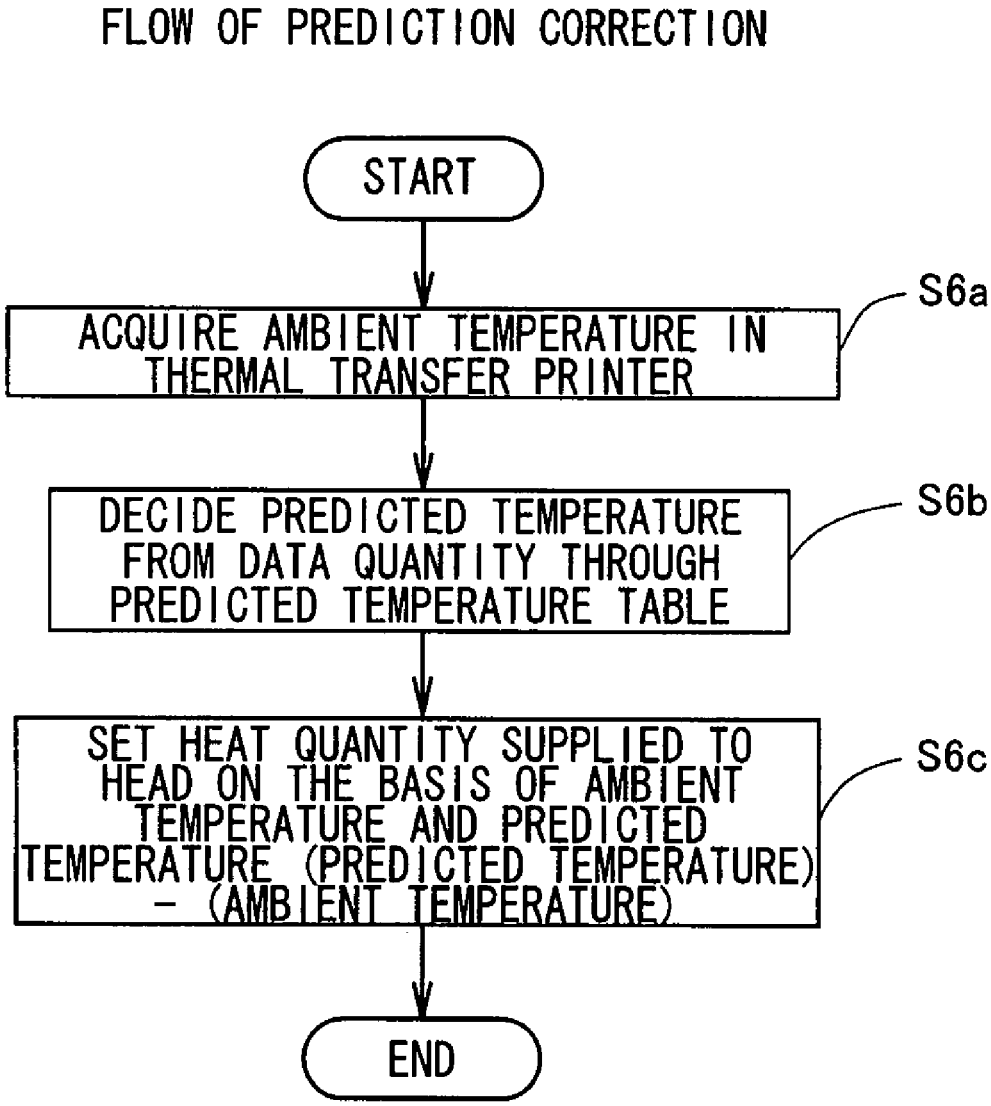
FIG. 20 is a flow chart for illustrating prediction correction in the thermal transfer printer according to the embodiment shown in FIG. 1.

At a step S1 shown in FIG. 19, a determination is made as to whether or not a power supply portion of the thermal transfer printer is in an ON-state. If the determination is of NO, the step S1 is repeated until the power supply portion enters an ON-state. If the determination is of YES, on the other hand, the process advances to a step S2.

At the step S2, the control portion 22*a* (see FIG. 4) determines whether or not a printing start instruction is received. If the determination is of NO, the step S2 is repeated until the printing start instruction is received. If the determination is of YES, on the other hand, the process advances to a step S3. At the step S3, the control portion 22*a* reads image data.

At a step s4, the control portion 22*a* develops the read image data in the RAM 22*h* (see FIG. 4), and thereafter converts the image data from RGB data to CMY data. The three primary colors of light (R: red, G: green and B: blue) constitute the RGB data, while the three primary colors of object color (C: cyan, M: magenta and Y: yellow) constitute the CMY data.

At a step S5, the control portion 22*a* calculates data quantities of the respective colors developed in the three primary colors of object color (C: cyan, M: magenta and Y: yellow).

At a step S6, the control portion 22*a* performs prediction correction. In this prediction correction, the control portion 22*a* first acquires the ambient temperature in the thermal transfer printer at a step S6*a* shown in FIG. 20. In other words, the ambient temperature sensor 29 detects a voltage value corresponding to the ambient temperature in the thermal transfer printer. The A-D conversion portion 22*d* (see FIG. 4) converts the analog voltage value detected by the ambient temperature sensor 29 to a digital value utilized as temperature data. At a step S6*b*, the control portion 22*a* selects the predicated temperature corresponding to the data quantity of each color calculated at the step S5 from the predicated temperature table 22*f* (see FIG. 10). Thereafter the RAM 22*h* temporarily stores data of a temperature value obtained by subtracting the ambient temperature in the thermal printer from the selected predicted temperature at a step S6*c*.

At a step S7, each paper 14 is fed (carried) from the paper tray 25 (see FIG. 1) to a printing start position. In this paper feeding at the step S7, the motor 15 is driven for rotating the motor gear 15*a* mounted thereon along arrow C3 in FIG. 5 thereby rotating the feed roller gear 5 along arrow C1 in FIG. 5 through the intermediate gears 18 and 19, as shown in FIG. 5. Following the rotation of the feed roller gear 5 along arrow C1 in FIG. 5, the paper feed roller gear 9 is rotated along arrow C4 in FIG. 5 through the intermediate gears 20 and 21. Thus, the paper feed roller 8 is also rotated along arrow C4 in FIG. 3, thereby carrying the paper 14 coming into contact with the lower surface of the paper feed roller 8 in the paper feed direction (along arrow T1 in FIG. 3), as shown in FIG. 3. Consequently, the paper 14 is guided by the lower paper guide 7*a* and carried to the printing start position by the feed roller 4 and the press roller 6.

At this time, the swing gear 17 swings in a direction (along arrow C2 in FIG. 5) for separating from the gear portion 12*a* of the take-up reel 12 as shown in FIG. 5, not to mesh with the gear portion 12*a* of the take-up reel 12. Thus, the gear portion 12*a* of the take-up reel 12 remains unrotational in paper feeding, not to take up the ink sheet 26 wound on the take-up bobbin 27*b* and the supply bobbin 27*c* (see FIG. 3).

Figure 21:
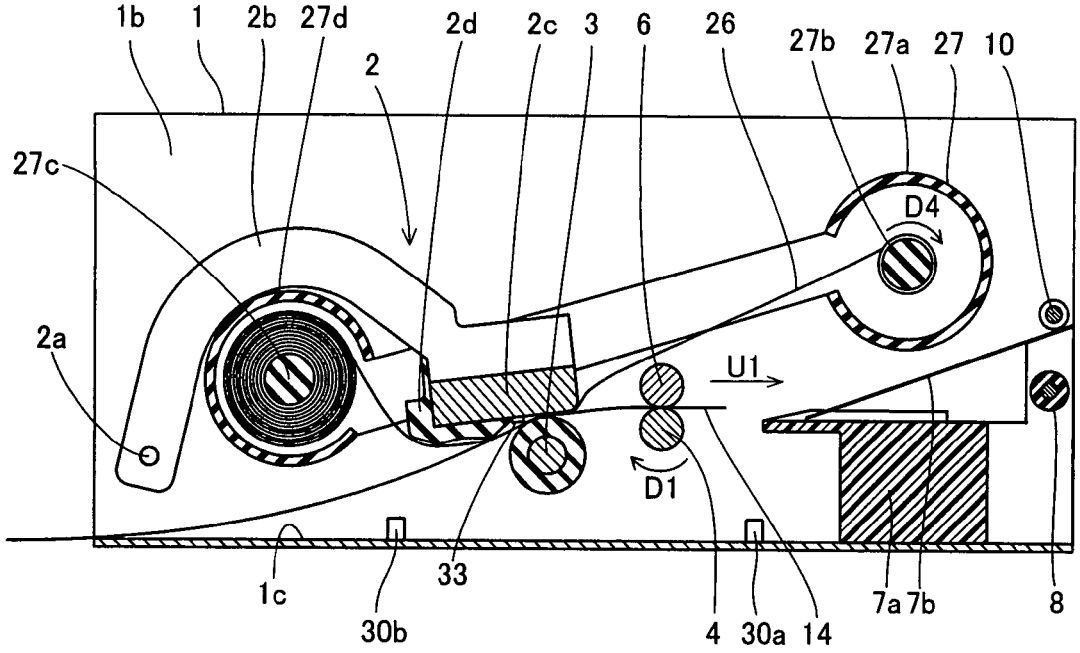
FIGS. 21 and 22 are sectional views for illustrating the printing operation of the thermal transfer printer according to the embodiment shown in FIG. 1.

At a step S8, the control portion 22*a* drives the motor 16 for rotating the thermal head 2 through the motor driver 22*c* (see FIG. 4). Thus, the head portion 2*c* of the thermal head 2 is rotated toward the platen roller 3, as shown in FIG. 21. Consequently, the head portion 2*c* of the thermal head 2 presses the platen roller 3 through the ink sheet 26 and the paper 14. Thereafter the control portion 22*a* initializes the counter 22*i* (see FIG. 4) provided thereon and sets the variable numbers of the lines (l) and the dots (i) to "0" respectively.

At a step S10, the control portion 22*a* performs line printing. In the line printing at the step S10, the control portion 22*a* drives the motor 15 for paper feeding for rotating the motor gear 15*a* along arrow D3 in FIG. 5 thereby rotating the feed roller gear 5 along arrow D1 in FIG. 5 through the intermediate gears 18 and 19, as shown in FIG. 5. Thus, the feed roller 4 is rotated along arrow D1 in FIG. 21, thereby carrying the paper 14 in a paper discharge direction (along arrow U1 in FIG. 21), as shown in FIG. 21. The paper 14 is carried line by one in the paper discharge direction.

As shown in FIG. 5, the swing gear 17 swings in a direction (along arrow D2 in FIG. 5) for meshing with the gear portion 12*a* of the take-up reel 12, as shown in FIG. 5. Thus, the gear portion 12*a* of the take-up reel 12 is rotated along arrow D4 in FIG. 5, thereby taking up the ink sheet 26 wound on the take-up bobbin 27*b* and the supply bobbin 27*c* (see FIG. 21). The ink sheet 26 is taken up line by one as the paper 14 is carried line by line in the paper discharge direction.

At this time, the head temperature sensor 33 (see FIG. 6) detects a voltage value corresponding to the temperature around the heating elements 2*e* (see FIG. 6) of the thermal head 2. The A-D conversion portion 22*d* (see FIG. 4) converts the analog voltage value detected by the head temperature sensor 33 to a digital value utilized as head temperature data. The control portion 22*a* reads the temperature value obtained by subtracting the ambient temperature in the thermal transfer printer from the selected predicted temperature stored in the RAM 22*h* at the step S6, and calculates a corrected temperature by subtracting the temperature value obtained by subtracting the ambient temperature in the thermal transfer printer from the predicted temperature from the head temperature.

Figure 22:
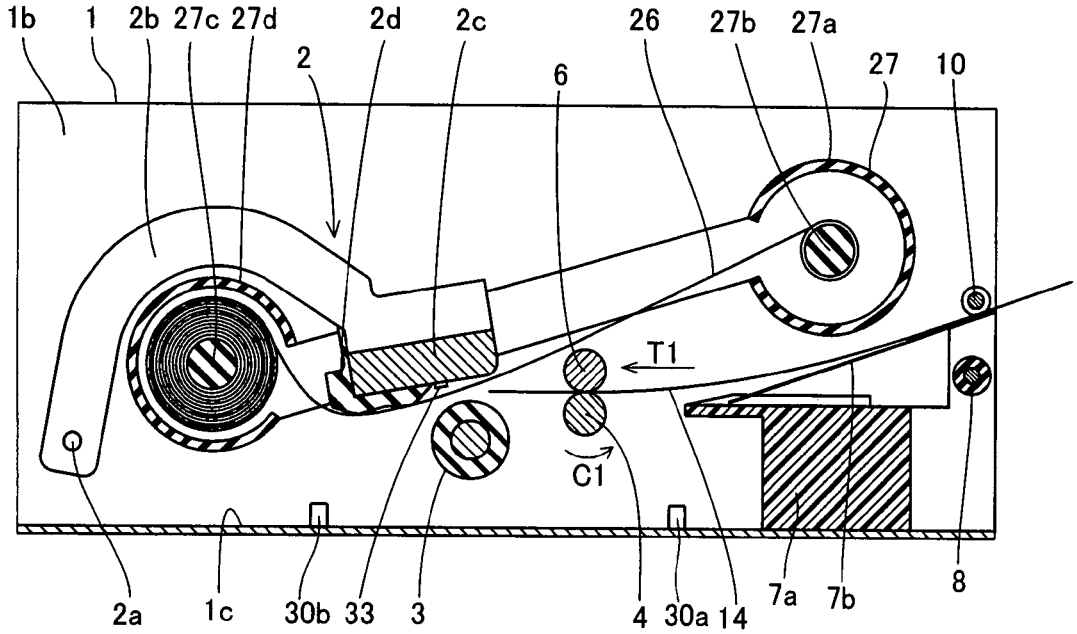

The head controller 22*b* applies voltage pulses responsive to the gradation corresponding to the corrected temperature to the plurality of heating elements 2*e* (see FIG. 6) of the thermal head 2 on the basis of the color table 22*e* (see FIG. 9). Thus, the plurality of heating elements 22*e* generate heat up to temperatures responsive to the corresponding gradation. Consequently, the color Y printing sheet 26*a* (see FIG. 7) of the ink sheet 26 is so heated as to transfer the ink from the color Y printing sheet 26*a* to the paper 14 line by line. The head controller 22*b* applies the voltage pulses to the heating elements 2*e* of the thermal head 2 every time the paper 14 is carried in the paper discharge direction by one line. When the printing through the color Y printing sheet 26*a* is completed, the paper 14 is guided by the upper paper guide 7*b* and carried to a position carriable by the paper discharge roller 10 and the feed roller 4, as shown in FIG. 22. Thereafter the control portion 22*a* prints the colors M and C through operations similar to the aforementioned printing operation for the color Y.

At a step S11, the control portion 22*a* determines whether or not printing is completely performed on all lines (1800 lines) of the paper 14. If the determination is of NO, the process returns to the step S10 for line printing. If the determination is of YES, on the other hand, the process advances to a step S12. At the step S11, the control portion 22*a* makes the determination every time the colors (Y, M and C) are printed.

At the step S12, the control portion 22*a* determines whether or not all colors have been completely printed from the ink sheet 26. If the determination is of NO, the control portion 22*a* repeats the printing operation through the steps S6 to S11. If the determination is of YES, on the other hand, the process advances to a step S13.

At the step S13, the ink is printed from the transparent OP (overcoat) sheet 26*d* (see FIG. 7), thereby completing the printing on the paper 14. In paper discharge, the paper 14 is guided by the upper paper guide 7*b* and discharged from the thermal transfer printer by the discharge roller 10. Thereafter the sheet search sensor (not shown) searches for the color Y printing sheet 26*a* of the ink sheet 26 for subsequent printing. Thus, the control portion 22*a* ends the printing operation. In paper discharge, the paper 14 is discharged through an operation similar to that in the aforementioned case of carrying the paper 14 in the paper discharge direction (along arrow U1 in FIG. 21) in printing.

The thermal transfer printer according to this embodiment performs the line printing in the aforementioned manner.

According to this embodiment, as hereinabove described, the thermal transfer printer performs printing by predicting an ambient temperature in the thermal transfer printer substantially reaching a constant level after continuously printing the same print image from the data quantity of the print image and adding the heat quantity corresponding to the difference between the predicted ambient temperature in the thermal transfer printer and the printing-time ambient temperature in the thermal transfer printer detected by the ambient temperature sensor 29 to the heat quantity of the thermal head 2 for supplying a heat quantity for the same ambient temperature as that substantially reaching the constant level after performing continuous printing on a constant number of papers in an initial stage of continuously printing the same image, thereby sufficiently reducing dispersion of the printing quality in the initial stage of continuous printing and after performing printing on the constant number of papers. Further, the thermal transfer printer, so formed as to perform printing in consideration of not only the heat quantity based on the aforementioned ambient temperature but also the heat quantity of the thermal head 2 decided in response to the printing-time temperature of the thermal head 2 detected by the head temperature sensor 33, can suppress influence exerted on the printing quality by the temperature of the thermal head 2, thereby sufficiently reducing dispersion of the printing quality in the initial stage of continuous printing and after performing printing on the constant number of papers.

According to this embodiment, as hereinabove described, the control portion 22*a*, so formed as to predict the ambient temperature in the thermal transfer printer substantially reaching the constant level after continuous printing from the data quantity of the print image defined by the integers 1 to 70 on the basis of the predicted temperature table 22*f*, can predict the ambient temperature in the thermal transfer printer responsive to the data quantity, thereby correctly predicting the ambient temperature substantially reaching the constant level after performing continuous printing with the data quantity. Thus, the error between the predicted ambient temperature and the actual ambient temperature substantially reaching the constant level can be sufficiently reduced for further sufficiently reducing dispersion of the printing quality in the initial stage of continuous printing and after performing printing on the constant number of papers.

According to this embodiment, as hereinabove described, the control portion 22*a* decides the heat quantity supplied to the thermal head 2 through the color table 22*e* with the value obtained by subtracting the difference between the predicted ambient temperature in the thermal transfer printer and the detected printing-time ambient temperature in the thermal transfer printer from the temperature of the thermal head 2, whereby the heat quantity supplied to the thermal head 2 can be easily decided in consideration of both of the ambient temperature data in the thermal transfer printer and the temperature data of the thermal head 2.

According to this embodiment, as hereinabove described, the predicted temperature table 22*f* and the color table 22*e* are individually provided for the respective ones of the three primary colors Y, M and C of object color so that the heat quantity supplied to the thermal head 2 can be decided on the basis of the data quantities of the colors Y, M and C, thereby sufficiently reducing dispersion of the printing quality in the initial stage of continuous printing and after performing printing on the constant number of papers for the respective colors. Thus, the printing quality can be further stabilized. Thus, the printing quality can be further stabilized.

According to this embodiment, as hereinabove described, the predicated temperature table 22*f* of the data quantities and the predicted temperatures is created by measuring the ambient temperature in the thermal transfer printer substantially reaching the constant level after performing continuous printing with the five types of grays (gray 1 to gray 5) having different data quantities, thereafter plotting the relations between the data quantities and the ambient temperature in the thermal transfer printer substantially reaching the constant level after continuous printing on graphs and calculating the relational expressions of approximate lines on the basis of plotted points so that the predicted ambient temperature can be calculated also as to an unplotted data quantity, whereby the predicted temperature table 22*f* can be detailedly created.

According to this embodiment, the thermal head 2 is provided with the plurality of heating elements 2*e* aligned with each other in the direction X perpendicular to the paper feed direction Y for calculating the data quantity of the print image by multiplying the product of the number (1280) of the heating elements 2*e* and the number (1800) of columns printed by the linearly arranged heating elements 2*e* on the paper 14 in the paper carrying direction Y by the number (256) of gradations of the heating elements 2*e*, whereby the heat quantity supplied to the overall paper 14 can be easily obtained.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment of the present invention is applied to the thermal transfer printer, the present invention is not restricted to this but is also applicable to another image generating apparatus other than the thermal transfer printer, so far as the same has a thermal head.

While the control portion predicts the ambient temperature in the thermal transfer printer on the basis of the previously created predicted temperature table defining the relations between the data quantities and the predicted ambient temperatures in the thermal transfer printer in the aforementioned embodiment, the present invention is not restricted to this but the control portion may alternatively predict the ambient temperature in the thermal transfer printer every data quantity regardless of the predicted temperature table.

While the control portion decides the heat quantity supplied to the thermal head through the color table with the value obtained by subtracting the difference between the predicted ambient temperature in the thermal transfer printer and the detected printing-time ambient temperature in the thermal printer from the detected temperature of the thermal head in the aforementioned embodiment, the present invention is not restricted to this but the control portion may alternatively decide the heat quantity supplied to the thermal head through calculation regardless of the color table.

While the predicted temperature table defining the relations between the data quantities and the predicted ambient temperatures is created by plotting the relation between the actually measured ambient temperature in the thermal transfer printer and the number of printed papers and calculating the expressions of the approximate lines from the plots in the aforementioned embodiment, the present invention is not restricted to this but the predicted temperature table defining the relations between the data quantities and the predicted ambient temperatures may alternatively be created only through the actually measured ambient temperature in the thermal transfer printer without employing the approximate lines.

What is claimed is:

1. An image generating apparatus comprising:

a thermal head for printing a print image;

an apparatus body storing said thermal head;

a first temperature sensor for detecting the temperature of said thermal head;

a second temperature sensor for detecting an ambient temperature indicating the temperature of the atmosphere in said apparatus body; and a control portion printing said print image by predicting an ambient temperature in said apparatus body substantially reaching a constant level after continuously printing the same print image as said print image from a data quantity of said print image and adding a heat quantity corresponding to the difference between predicted said ambient temperature in said apparatus body and a printing-time ambient temperature in said apparatus body detected by said second temperature sensor and a printing-time temperature of said thermal head detected by said first temperature sensor to a heat quantity of said thermal head.

2. The image generating apparatus according to claim 1, further comprising a previously created first table defining the relation between data quantities and said predicted ambient temperature in said apparatus body, wherein said control portion is so formed as to predict said ambient temperature in said apparatus body substantially reaching said constant level after continuous printing from the data quantity of said print image on the basis of said first table.

3. The image generating apparatus according to claim 2, further comprising a second table defining the relation between a corrected temperature of said thermal head and the heat quantity supplied to said thermal head, wherein said control portion is so formed as to decide said heat quantity supplied to said thermal head through said second table with a corrected temperature calculated by subtracting the difference between said predicted ambient temperature in said apparatus body and said printing-time ambient temperature in said apparatus body detected by said second temperature sensor from the temperature of said thermal head detected by said first temperature sensor.

4. The image generating apparatus according to claim 3, wherein said first table and said second table are individually provided for the respective ones of three primary colors of object color.

5. The image generating apparatus according to claim 2, wherein said first table is created by measuring said ambient temperature in said apparatus body every print number when continuously printing each of print images of different data quantities on a plurality of papers thereby deciding said ambient temperature in said apparatus body substantially reaching said constant level after continuous printing on a plurality of papers, thereafter plotting the relation between each said data quantity and said ambient temperature in said apparatus body substantially reaching said constant level after continuous printing every said data quantity, calculating a first relational expression of an approximate line on the basis of plotted points and defining the relation between each said data quantity and said predicted ambient temperature in said apparatus body from the first relational expression of said approximate line.

6. The image generating apparatus according to claim 5, wherein said ambient temperature in said apparatus body substantially reaching said constant level after continuous printing on a plurality of papers is calculated by a second relational expression of an approximate line based on said ambient temperature in said apparatus body every print number.

7. The image generating apparatus according to claim 5, wherein said ambient temperature in said apparatus body substantially reaching said constant level after continuous printing on a plurality of papers includes said ambient temperature in said apparatus body for maximum number of continuously printable papers.

8. The image generating apparatus according to claim 1, wherein said second temperature sensor is arranged on a region, corresponding to said thermal head, located above said thermal head.

9. The image generating apparatus according to claim 1, wherein said thermal head includes a plurality of heating elements so arranged as to linearly extend in a direction perpendicular to a paper carrying direction, and the data quantity of said print image is calculated by multiplying the product of the number of said heating elements and the number of columns printed by said linearly arranged heating elements on said paper in said paper carrying direction by the number of gradations of said heating elements.

10. An image generating apparatus comprising:

a thermal head for printing a print image;

an apparatus body storing said thermal head;

a first temperature sensor for detecting the temperature of said thermal head;

a second temperature sensor for detecting an ambient temperature indicating the temperature of the atmosphere in said apparatus body;

a previously created first table defining the relation between data quantities and a predicted ambient temperature in said apparatus body;

a second table defining the relation between a corrected temperature of said thermal head and the heat quantity supplied to said thermal head; and a control portion printing said print image by predicting an ambient temperature in said apparatus body substantially reaching a constant level after continuously printing the same printing image as said print image from a data quantity of said print image and adding a heat quantity corresponding to the difference between predicted said ambient temperature in said apparatus body and printing-time ambient temperature in said apparatus body detected by said second temperature sensor and a printing-time temperature of said thermal head detected by said first temperature sensor to a heat quantity of said thermal head, wherein said control portion is so formed as to predict said ambient temperature in said apparatus body substantially reaching said constant level after continuous printing from the data quantity of said print image on the basis of said first table, for deciding the heat quantity supplied to said thermal head through said second table with a corrected temperature calculated by subtracting the difference between said predicted ambient temperature in said apparatus body and said printing-time ambient temperature in said apparatus body detected by said second temperature sensor from the temperature of said thermal head detected by said first temperature sensor, said first table and said second table are individually provided for the respective ones of three primary colors of object color, and said first table is created by measuring said ambient temperature in said apparatus body every print number when continuously printing each of print images of different data quantities on a plurality of papers thereby deciding said ambient temperature in said apparatus body substantially reaching said constant level after continuous printing on a plurality of papers, thereafter plotting the relation between each said data quantity and said ambient temperature in said apparatus body substantially reaching said constant level after continuous printing every said data quantity, calculating a first relational expression of an approximate line on the basis of plotted points and defining the relation between each said data quantity and said predicted ambient temperature in said apparatus body from the first relational expression of said approximate line.

11. The image generating apparatus according to claim 10, wherein said ambient temperature in said apparatus body substantially reaching said constant level after continuous printing on a plurality of papers, is calculated by a second relational expression of an approximate line based on said ambient temperature in said apparatus body every print number.

12. The image generating apparatus according to claim 10, wherein said ambient temperature in said apparatus body substantially reaching said constant level after continuous printing on a plurality of papers includes said ambient temperature in said apparatus body for a maximum number of continuously printable papers.

13. The image generating apparatus according to claim 10, wherein said second temperature sensor is arranged on a region, corresponding to said thermal head, located above said thermal head.

14. The image generating apparatus according to claim 10, wherein said thermal head includes a plurality of heating elements so arranged as to linearly extend in a direction perpendicular to a paper carrying direction, and the data quantity of said print image is calculated by multiplying the product of the number of said heating elements and the number of columns printed by said linearly arranged heating elements on said paper in said paper carrying direction by the number of gradations of said heating elements.

* * * * *